US006286492B1

(12) United States Patent
Kanno

(10) Patent No.: US 6,286,492 B1
(45) Date of Patent: Sep. 11, 2001

(54) FUEL INJECTION CONTROL

(75) Inventor: Isao Kanno, Hamamatsu (JP)

(73) Assignee: Sanshin Kogyo Kabushiki Kaisha, Shizuoka (JP)

( * ) Notice: Subject to any disclaimer, the term of this patent is extended or adjusted under 35 U.S.C. 154(b) by 0 days.

(21) Appl. No.: 09/536,241

(22) Filed: Mar. 27, 2000

(30) Foreign Application Priority Data

Mar. 25, 1999 (JP) ..... 11-081111

(51) Int. Cl.[7] ..... F02D 41/18
(52) U.S. Cl. ..... 123/684
(58) Field of Search ..... 123/435, 684

(56) References Cited

U.S. PATENT DOCUMENTS 4,408,584 * 10/1983 Yabuhara et al. ..... 123/440
4,941,448 * 7/1990 Nakaniwa et al ..... 123/488
5,937,825 8/1999 Motose .
5,941,223 8/1999 Kato .
5,983,878 11/1999 Nonaka et al. .
6,015,319 1/2000 Tanaka .

OTHER PUBLICATIONS

Eric Chowanietz; "Automobile Electronics"; Published 1995; pp. 112 & 115.

* cited by examiner

*Primary Examiner*—Erick Solis
(74) *Attorney, Agent, or Firm*—Knobbe, Martens, Olson & Bear, LLP

(57) ABSTRACT

An engine includes an electronic controller which samples the pressure in the induction system once per rotation of the crankshaft. The controller is configured to determine the minimum voltage signal output by the pressure sensor. The controller then uses the minimum pressure sensed by the pressure sensor to control the fuel injection of the engine. The controller may include two and/or three dimensional maps for predicting the appropriate timing for sampling the pressure sensor. Optionally, the controller may include a bottom hold device for holding a minimum value of the signal output from the pressure sensor, thus corresponding to the minimum pressure sensed by the pressure sensor.

38 Claims, 11 Drawing Sheets

247 248 246

| Engine Speed Nx | Peak Crank Pos. Dx |
|---|---|
| N1 | D1 |
| N2 | D2 |
| N3 | D3 |
| N4 | D4 |
| | |
| Nn | Dn |
| | |

*Figure 8*

FUEL INJECTION CONTROL

PRIORITY INFORMATION

This application is based on and claims priority to Japanese Patent Application No. 11-081111, filed Mar. 25, 1999.

BACKGROUND OF THE INVENTION

1. Field of the Invention

The present invention is directed to a controller for an engine, and in particular, a controller for a fuel-injected engine which controls the fuel injectors based on a detected intake air pressure.

2. Description of Related Art

In all fields of engine design, there is an increasing emphasis on obtaining more effective emission control, better fuel economy, and at the same time, continued high or higher power output. This trend has resulted in the substitution of fuel injection systems for carburetors as the charge former for internal combustion engines. Typically, fuel injection systems for internal combustion engines receive input from a variety of sensors included on the engine which are configured to output data which reflect the operating conditions of the engine. For example, a fuel-injected engine may include an engine speed sensor, an air temperature sensor, a throttle position sensor, an engine temperature sensor, and an air flow sensor. The controller for the engine monitors each of these sensors to determine the appropriate fuel injection timing and duration corresponding to the detected conditions. Thus, as the accuracy of the sensors and the processing of the data from the sensors is increased, so is the accuracy of the fuel injection duration and timing calculations and the emissions and the fuel efficiency of the engine.

Among the various types of data monitored by the controllers of fuel-injected engines, accurate determination of air flow into the engine poses a unique challenge. Although the flow of induction air into an engine is controlled by a throttle valve, it is imperative to determine the mass flow rate of the induction air into the engine in order to determine the appropriate mass of fuel required to accurately produce the desired air/fuel ratio. In some applications, the mass flow rate of air into the engine is estimated by detecting the absolute pressure within the induction manifold (manifold absolute pressure or "MAP") which is proportional to the total volume of air drawn into the engine. The absolute pressure is then used, in combination with other data collected from various other sensors, by the engine controller in order to calculate the mass air flow rate into the engine. Such calculations are known as volume-density computations or speed-density computations.

Recently, air flow meters have been used with fuel-injected engines which directly measure air flow rates of induction air into the engine. For example, known air flow meters include suspended-plate-type flow sensors, swinging-gate-type air flow sensors, and mass-flow sensors. However, these flow meters provide additional bulk and make engines more expensive to manufacture.

SUMMARY OF THE INVENTION

A need therefore exists for a less expensive fuel injection control system for an engine which accurately determines a flow rate of induction air into the engine.

One aspect of the present invention includes the realization that the timing during a combustion cycle, i.e., the crankangle position of a crankshaft, at which a minimum induction air pressure is generated within an internal combustion engine varies substantially in accordance with changes in engine speed and another engine operation characteristic. For example, in a four-cycle internal combustion engine, air is drawn into the respective cylinders when the intake valve is open and the piston moves downwardly within the cylinder, i.e., during the "intake stroke." The intake stroke occurs once every two revolutions of the crankshaft. Thus, within the engine operation speeds between 1,000 rpm and 6,000 rpm, air is drawn through the induction system in pulses of a frequency from about 500 times per minute to 3,000 times per minute.

As induction air is drawn into the induction system, the absolute pressure generated in the induction system predictably falls in accordance with the vacuum generated by the downward movement of the piston. The actual mass flow rate attained by the induction air is affected by numerous conditions. For example, although the diameter of the cylinder and the stroke length of the piston of an internal combustion engine remain constant during operation, the atmospheric air pressure, temperature, and density may change in accordance with environmental conditions. Internal combustion engines having the same cylinder diameter and stroke length may also have differently configured induction systems with different aerodynamic resistance. Internal combustion engines also may incorporate variable valve timing for at least the intake valves, thus affecting the flow of induction air differently at different engine speeds. Accordingly, the minimum absolute pressure generated in the induction system is a result of numerous factors which can affect the mass flow rate of induction air through the induction system.

Significantly, it has been found that the timing at which the minimum pressure in the induction system is generated predictably varies according to the position of a throttle valve in the induction system, as well as engine speed. Thus, an outboard motor constructed in accordance with the first aspect of the present invention includes an engine having an engine body defining at least one combustion chamber therein. A crankshaft is rotatably journaled at least partially within the engine body. An induction system is configured to guide induction air into the combustion chamber and a pressure sensor is configured to detect a pressure in the induction system. A charge former is connected to the engine to supply a fuel charge to the combustion chamber. An engine speed sensor is connected to the engine to detect rotation of the crankshaft. The outboard motor also includes a controller connected to the pressure sensor, and the engine speed sensor, and includes a memory containing data regarding a relationship between a plurality of peak positions of the crankshaft, a plurality of engine speeds, and a plurality of values of an engine operation characteristic other than engine speed, wherein the peak positions correspond to a position of the crankshaft when an induction air pressure in the induction system is at a substantially minimum value. The controller is configured to sample the output from the pressure sensor when the crankshaft is approximately at the peak position corresponding to the engine speed and the engine operation characteristic.

Preferably, the engine includes a throttle valve positioned in the induction system and configured to regulate a flow of induction air through the induction system. Additionally, the engine preferably includes a throttle position sensor configured to detect a position of the throttle valve, wherein the engine operation characteristic is the throttle valve position. Thus, the data contained in the memory reflects a relationship between the peak positions of the crankshaft, engine speed, and throttle valve positions. The controller samples the output from the pressure sensor when the crankshaft is at the peak position corresponding to the engine speed and the throttle position.

As noted above, one aspect of the present invention includes the realization that the peak position of the crankshaft predictably varies according to throttle valve position as well as engine speed. Thus, by including a memory containing data regarding a relationship between peak positions of the crankshaft, engine speeds and throttle positions, the controller can more accurately determine the timing at which the output of the pressure sensor should be sampled, thus obtaining a more accurate minimum pressure reading in the induction system and a more accurate fuel injection duration calculation.

One advantage stemming from a more accurate timing for sampling the air pressure sensor is that the controller can be configured to sample the air pressure sensor only once per rotation of the crankshaft. As such, the cost and complexity of the control system itself can be minimized. Thus, by configuring the controller to sample the output from the pressure sensor according to a timing based on engine speed and throttle position, the outboard motor according to the present invention more accurately determines the minimum air pressure in the induction system without increasing the cost and complexity of the controller or sensor.

Preferably, the outboard motor also includes a bottom hold device connected to the air pressure sensor. The bottom hold device is configured to substantially maintain a minimum output of the pressure sensor and output the maintained value to the controller. Thus, as the control unit samples the value held by the bottom hold device, the controller receives a signal that is indicative of the minimum pressure in the induction system, even if the timing of the sampling does not exactly coincide with timing of the actual minimum output.

According to another aspect of the invention, an outboard motor includes an engine having an engine body defining at least one combustion chamber therein. The crankshaft is rotatably journalled at least partially within the engine body. An induction system is configured to guide induction air into the combustion chamber and a pressure sensor is configured to detect a pressure in the induction system. A charge former is connected to the engine to supply fuel charge to the combustion chamber. The outboard motor also includes a controller connected to the pressure sensor. The motor also includes a bottom hold device configured to substantially maintain a minimum output of the pressure sensor and output the maintained value to the controller. Additionally, the bottom hold device includes a reset portion configured to generate the reset signal to reset the held voltage upon receiving a reset signal. The controller is configured to reset the bottom hold device after the output of the pressure sensor has been sampled.

By including a reset portion configured to reset the maintained voltage in the bottom hold device, the bottom hold device can be configured to decay slowly, or not at all, thus more accurately hold the minimum output value from the pressure sensor. Thus, the controller receives a signal that is a more accurate representation of the minimum output of the pressure sensor, thereby allowing the controller to more accurately determine fuel injection duration.

As is known in the art, injecting an air-fuel mixture that is stoichiometrically perfect into an internal combustion engine provides the highest specific power output and the lowest emissions. It is also well known in the art that known internal combustion engines do not reliably produce air-fuel charges with stoichiometrically perfect air-fuel mixtures. Additionally, if an air-fuel charge combusted in an internal combustion engine is excessively "lean," i.e., there is too little fuel in the charge, the engine can be damaged through "detonation," for example. Thus, it is common in the art to configure some charge formers to produce "rich" air-fuel charges. That is, some types of charge formers produce air-fuel charges that have more fuel than an air-fuel charge which is stoichiometrically perfect. Thus, these prior charge formers avoid damaging lean fuel charges by erring on the side of rich fuel charges, thereby protecting the engine but wasting fuel and discharging un-burnt fuel with the exhaust gases.

By constructing an engine in accordance with the present invention, more accurate fuel injection control is possible, thus allowing the engine controller to produce fuel charges that are more stoichiometrically correct, thus reducing fuel consumption and improving emissions of the engine.

BRIEF DESCRIPTION OF THE DRAWINGS

The above-mentioned and other features of the invention will now be described with reference to the drawings of the preferred embodiments of the present outboard motor. The illustrated embodiment of the outboard motor is intended to illustrate, but not to limit the invention. The drawings contain the following figures:

FIG. 8 is a two-dimensional map containing data regarding a relationship between engine speed and minimum intake air pressure.

DETAILED DESCRIPTION OF THE PREFERRED EMBODIMENTS OF THE INVENTION

Figure 1:
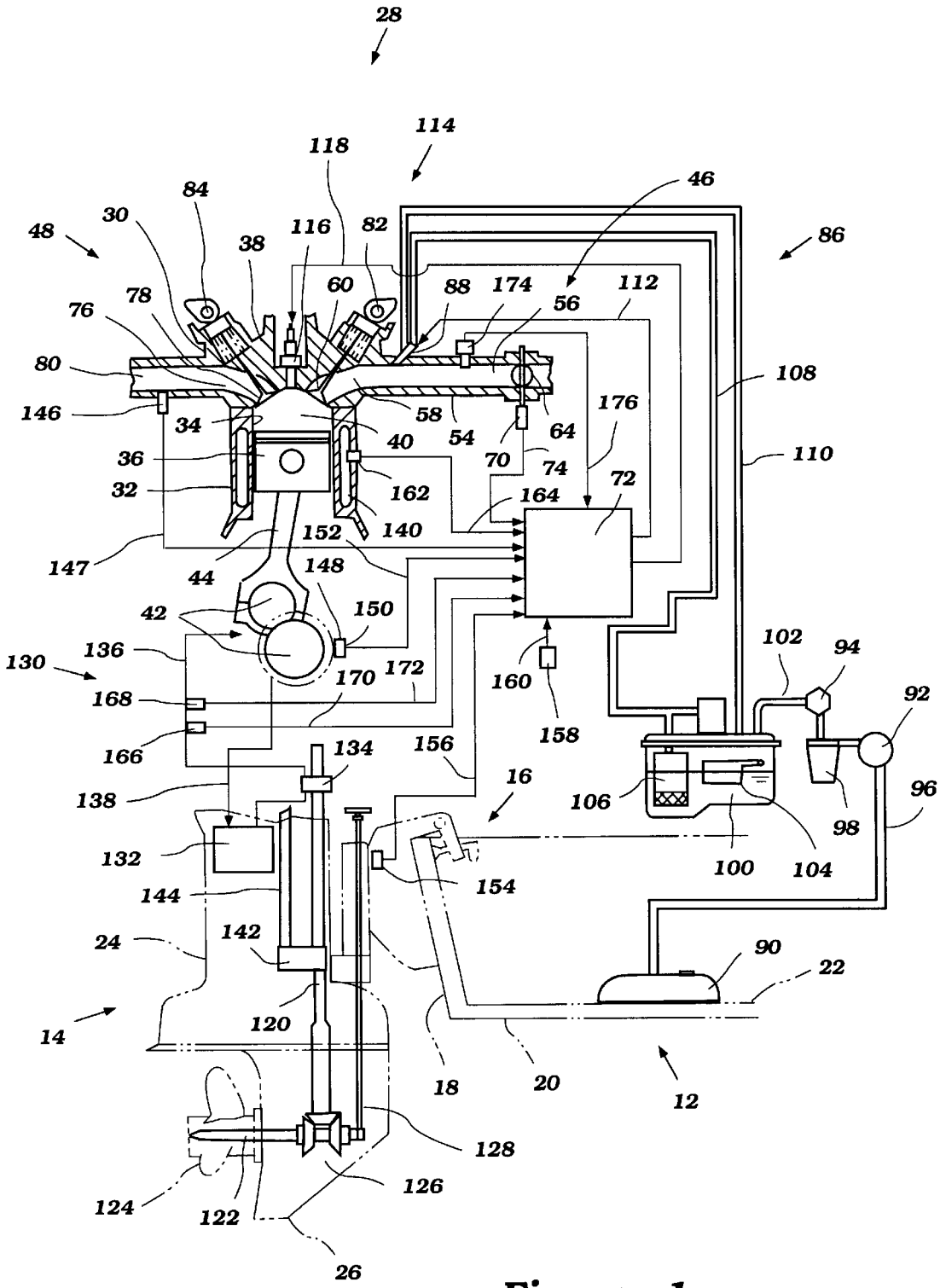
FIG. 1 is a schematic view showing an outboard motor including an engine, configured in accordance with a preferred embodiment of the invention. The engine, in part, and the ECU, are shown generally in the upper half of the figure. The outboard motor, in part, and a watercraft are shown in the lower half of the figure. The ECU, and the fuel injection system, link the two views together. The outboard motor and the associated watercraft are illustrated in phantom.

With initial reference to FIG. 1, an outboard motor 10 for powering a watercraft 12 is illustrated. The outboard motor 10 advantageously has an electronic control unit arranged and configured in accordance with certain features, aspects, and advantages of the present invention. The outboard motor 10 provides an exemplary environment in which the electronic control unit has particular utility. The electronic control unit of the present invention may also find utility in applications using internal combustion engines, such as, for example but without limitation, personal watercraft, small jet boats, off-road vehicles, racing vehicles, and heavy construction equipment.

In the illustrated embodiment, the outboard motor 10 comprises a drive unit 14 and a bracket assembly 16. Although schematically shown in FIG. 1, the bracket assembly 16 comprises a swivel bracket and a clamping bracket. The swivel bracket supports the drive unit 14 for pivotal movement about a generally vertically extending steering axis. The clamping bracket, in turn, is affixed to the transom 18 of the watercraft 12 and supports the swivel bracket for pivotal movement about a generally horizontally extending axis. A hydraulic tilt system can be provided between the swivel bracket and the clamping bracket to tilt up or down the drive unit 14. If this tilt system is not provided, the operator may tilt the drive unit 14 manually. Since the construction of the bracket assembly 16 is well known in the art, a further description is not believed to be necessary to enable those skilled in the art to practice the invention.

As used throughout this description, the terms "forward," "front" and "fore" mean at or to the forward side of the bracket assembly 16, and the terms "rear," "reverse" and "rearwardly" mean at or to the opposite side of the front side, unless indicated otherwise.

As shown in FIG. 1, the associated watercraft 12 is a powerboat. The watercraft 12 has a hull 20 that defines a deck 22. The watercraft 12 may include any number of seats disposed on the deck 22. Preferably, a steering wheel is mounted at an appropriate position on the deck 22. The steering wheel is coupled to the bracket assembly 16 of the outboard motor 10 so that the operator can remotely steer the motor 10 to the left and right.

With reference to FIG. 1, the drive unit 14 will now be described in detail. The drive unit 14 includes a driveshaft housing 24 and a lower unit 26. A powerhead 28 is disposed atop the drive unit 14 and includes an engine 30, a top protective cowling and a bottom protective cowling (not shown).

The engine 30 operates on a four-stroke combustion principle and powers a propulsion device. As shown in FIG. 1, the engine 30 includes a cylinder block 32 which defines at least one cylinder bore 34. In the illustrated embodiment, the cylinder block 44 defines four cylinder bores 34, which are generally horizontally extending and spaced generally vertically from each other. As such, the engine 30 is an L4 (in-line, four-cylinder) type.

A piston 36 reciprocates in each cylinder bore 34. It is to be noted that the engine may be of any type (V-type, W-type), may have other numbers of cylinders, and/or may operate under other principles of operation (two-cycle, rotary, or diesel principles).

A cylinder head assembly 38 is affixed to one end of the cylinder block 32 and defines four combustion chambers 40 with the pistons 36 and the cylinder bores 34. The other end of the cylinder block 32 is closed with a crankcase member (not shown) defining a crankcase chamber therein.

A crankshaft 42 extends generally vertically through the crankcase chamber and is journalled to rotate at least partially within the crankcase chamber. The crankshaft 42 is connected to the pistons 36 by connecting rods 44 and rotates with the reciprocal movement of the pistons 36 within the cylinder bores 34. The crankcase member is preferably located at the forwardmost position of the powerhead 28, and the cylinder block 32 and the cylinder head assembly 38 preferably extend rearwardly from the crankcase member.

The engine 30 includes an air induction system 46 and an exhaust system 48. The air induction system 46 is configured to supply air charges to the combustion chambers 40.

Figure 2:
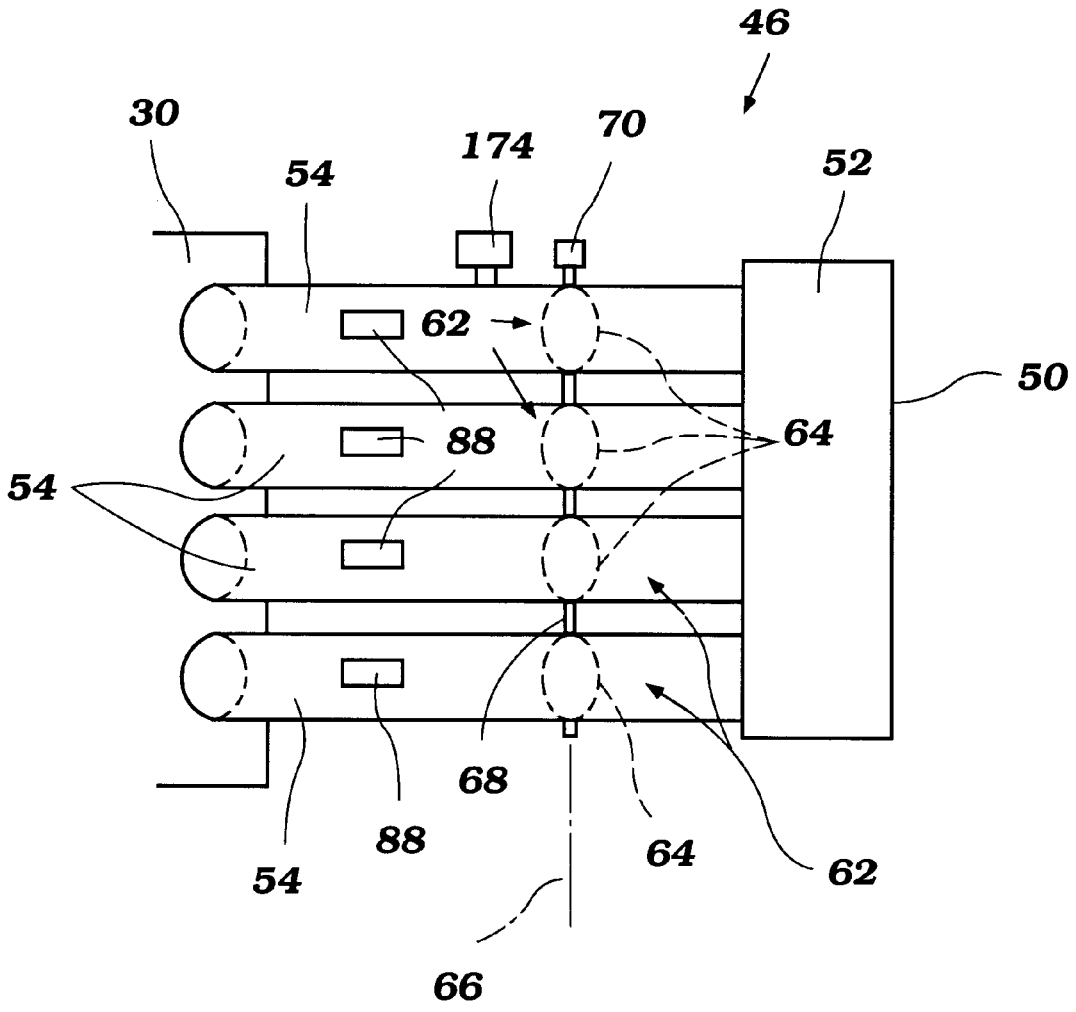
FIG. 2 is a schematic illustration of an induction system of the engine shown in FIG. 1.

With reference to FIG. 2, the induction system 46 includes a plenum chamber member 50 which defines a plenum chamber 52 therein. Four main intake runners 54 extend from the plenum chamber 52 and define a corresponding number of induction air intake passages 56 therein. The intake passages 56 extend from the plenum chamber 52 to a plurality of intake ports 58 formed in the cylinder head assembly 38.

With reference to FIG. 1, the intake ports 58 are opened and closed by intake valves 60. When the intake ports 58 are opened, air from the intake passages 56 and intake ports 58 flows into the combustion chambers 40.

The plenum chamber member 50 preferably includes an inlet opening that opens to an interior of the cowling of the outboard motor 10. The plenum chamber member 50 functions as an intake silencer and/or a collector of air charges.

Preferably, the plenum chamber member 50 is positioned on a forward side of the engine 30 and the induction passages 56 extend rearwardly from the plenum chamber member 50 to the intake ports 58. As shown in FIG. 2, the respective intake runners 54 are spaced vertically from each other.

As shown in FIG. 2, a throttle body 62 is provided within each intake runner 54. The respective throttle bodies 62 each support throttle valves 64 therein for pivotal movement about an axis 66 of a valve shaft 68 which extends generally vertically through each of the respective throttle bodies 64.

The throttle valves 64 are operated via a throttle cable (not shown) and preferably a nonlinear control mechanism (not shown). The throttle cable is connected to a throttle shift lever (not shown) that may be provided on a control handle connected to the outboard motor 10 or to a control mast (not shown) provided on the deck 22 of the watercraft 12.

With reference to FIG. 2, a throttle valve position sensor 70 is arranged atop of the throttle valve shaft 68. A signal from the position sensor 70 is sensed by an ECU 72 (FIG. 1) via a throttle position data line 74 for use in controlling various aspects of engine operation including, for example, but without limitation, fuel injection control, which will be described later. The signal from the throttle valve position sensor 70 corresponds to the engine load in one aspect, as well as the throttle opening. The ECU 72 preferably is mounted within the powerhead 28.

The air induction system 46 may also include a bypass passage or idle air supply passage that bypasses the throttle valves 64, although such is omitted from FIG. 2. The engine 30 also preferably includes an idle air adjusting unit (not shown) which is controlled by the ECU 72.

In operation, air is introduced into the powerhead 28 and passes through the inlet opening of the plenum chamber member 50. During operation of the engine 30, an air charge amount is controlled by the throttle valves 64 to meet the requirements of the engine 30. The air charge then flows through the runners 54 into the intake ports 58.

As described above, the intake valves 60 are provided at the intake ports 58. When the intake valves are opened, the air is supplied to the combustion chambers 40 as an air charge. Under the idle running condition, the throttle valves 64 are generally closed. The air, therefore, enters the ports 58 through the idle air adjusting unit (not shown) which is controlled by the ECU 72. The idle air charge adjusted in the adjusting unit is then supplied to the combustion chambers 40 via the intake ports 58.

With reference to FIG. 1, the exhaust system 48 is configured to discharge burnt gases or exhaust gases outside of the outboard motor 10 from the combustion chambers 40. Exhaust ports 76 are defined in the cylinder head assembly 38 and are opened and closed by exhaust valves 78. When the exhaust ports 76 are opened, the combustion chambers 40 communicate with a single or multiple exhaust passages 80 which guide the exhaust gases downstream through the exhaust system 48.

An intake camshaft 82 and an exhaust camshaft 84 are provided to control the opening and closing of the induction valves 60 and the exhaust valves 78, respectively. The camshafts 82, 84 extend approximately vertically and parallel with each other. The camshafts 82, 84 have cam lobes that act against the valves 60, 78, at predetermined timings to open and close the respective ports. The camshafts 82, 84 are journaled on the cylinder head assembly and are driven by the crankshaft 42 via a camshaft drive unit (not shown).

With reference to FIG. 1, the engine 30 also includes a fuel injection system 86. The fuel injection system 86 includes four fuel injectors 88 which have injection nozzles exposed to the intake ports 58 so that injected fuel is directed toward the combustion chambers 40. A main fuel supply tank 90 is part of the fuel injection system and is placed in the hull 20 of the associated watercraft 12. Although any place on the deck 22 is available, in the illustrated embodiment, the fuel tank 90 is positioned near the transom 18 of the watercraft 12.

Fuel is drawn from the fuel tank 90 by a first low-pressure pump 92 and a second low-pressure pump 94 through a first fuel supply conduit 96. The first low-pressure pump 92 is a manually operated pump. The second low-pressure pump 94 is a diaphragm-type pump operated by one of the intake and exhaust camshafts 82, 84. A quick-disconnect coupling (not shown) is preferably provided in the first fuel conduit 96. A fuel filter 98 is also positioned in the conduit 96 at an appropriate location.

From the low-pressure pump 94, fuel is supplied to a vapor separator 100 through a second fuel supply conduit 102. At the vapor separator end of the conduit 102, a float valve 104 is provided which is operated by a float so as to maintain a uniform level of the fuel contained in the vapor separator 100.

A high-pressure fuel pump 106 is provided within the vapor separator 100 and pressurizes fuel within the vapor separator 100. The high-pressure fuel pump 106 is connected with the fuel injectors 88 through a fuel delivery conduit 108. Preferably, the conduit 108 itself forms a fuel rail connecting the fuel injectors 88 with the high-pressure fuel pump 106. The high-pressure fuel pump 106 is driven by an electric motor that is directly connected to the pump 106 at its lower end, as viewed in FIG. 1. The electric motor is activated by the ECU 72 and is controlled via a fuel pump control line (not shown).

A fuel return conduit 110 is also provided between the fuel injectors 88 and the vapor separator 100. Excess fuel that is not injected by the injectors 88 returns to the vapor separator 100 through the conduit 110. A pressure regulator may be provided so as to communicate with either the fuel supply conduit 108 or the fuel return conduit 110 to limit the pressure of the fuel delivered to the fuel injectors 88. The flow generated by the return of unused fuel from the fuel injectors aids in cooling the fuel injectors 88. The timing and duration of fuel injection is dictated by the ECU 72, which is described below in detail.

The fuel charge delivered by the fuel injectors 88 then enters the combustion chambers 40 with an air charge at the moment the intake valves 60 are opened. Since the fuel pressure is regulated by the pressure regulator, a duration during which the nozzles of the injectors 88 are opened is a factor determined by the 72 to measure the amount of fuel to be injected by the fuel injector 88. The duration and the injection timing are thus controlled by the ECU 72 through fuel injector control line 112. Preferably, the fuel injectors 88 are opened by solenoids, as is known in the art. Thus, the fuel injector control line 112 signals the solenoids to open according to the timing and duration determined by the ECU 72.

The engine 30 further includes an ignition system, indicated generally by the reference numeral 114. Four spark plugs 116 are fixed on the cylinder head assembly 38 and exposed into the respective combustion chambers 40. The spark plugs 116 ignite an air fuel charge at a timing as determined by the ECU 72 to burn the air fuel charge therein. For this purpose, the ignition system 114 preferably includes an ignition coil (not shown) interposed between the spark plugs 116 and the ECU 72 along a spark plug control line 118.

The engine 30 also preferably includes an AC generator (not shown) for generating electrical power. Additionally, the outboard motor 10 preferably includes a battery (not shown) for storing electrical energy from the AC generator and to supply electrical power to other electrical equipment including the ECU 72, the solenoids controlling the fuel injectors, and the ignition coil.

While not illustrated, the engine 30 also can include a recoil strutter to drive the crankshaft 42 for starting the engine 30. A starter motor can be employed in addition or in the alternative to the recoil starter for the same purpose. The use of the starter motor is preferred when the present invention is employed with larger size engines. The recoil starter is operated by an operator of the watercraft 12 when the operator wants to start the engine 30.

Although not illustrated in FIG. 1, the driveshaft housing 24 depends from the powerhead and supports a driveshaft 120 which is driven by the crankshaft 42 of the engine 30. The driveshaft 120 extends generally vertically through the driveshaft housing 24. The driveshaft housing 24 also defines internal passages which form portions of the exhaust system 48.

The lower unit 26 depends from the driveshaft housing 24 and supports the propeller shaft 122 which is driven by the driveshaft 120. The propeller shaft 122 extends generally horizontally through the lower unit 26. In the illustrated embodiment, the propulsion device includes a propeller 124 that is affixed to an outer end of the propeller shaft 122 and is thereby driven.

A transmission 126 is provided between the driveshaft 120 and the propeller shaft 122. The transmission 126 couples together the two shafts 120, 122 which lie generally normal to each other (i.e., at a 90° angle) with a beveled gear combination.

A switch-over mechanism is provided for the transmission 126 to shift rotational directions of the propeller 124 between forward, neutral and reverse. The switch-over mechanism includes a shift cam (not shown), a shift rod 128 and a shift cable (not shown). The shift rod 128 extends generally vertically through the driveshaft housing 24 and the lower unit 26, while the shift cable extends outwardly from the cowling and is connected to a throttle/shift lever that is operable by the operator when the operator wants to shift the transmission's direction.

The lower unit 26 also defines an internal passage that forms a discharge section of the exhaust system 48. At engine speed above idle, the majority of the exhaust gases are discharged to the body of water surrounding the outboard motor 10 through the internal passage and finally through a hub of the propeller 124.

The engine 30 also preferably includes a lubrication system 130, which is schematically represented in FIG. 1. The lubrication system 130 is provided for lubricating certain portions of the engine 30, such as, for example, but without limitation, the pivotal joints of the connecting rods 44 with the crankshaft 42 within the crankcase and the walls of the cylinder bores 34.

The lubricant reservoir 132 is disposed at an appropriate location in the driveshaft housing 24. Lubricant in the reservoir 132 is drawn therefrom by a lubricant pump 134. In the illustrated embodiment, the lubricant pump 134 is driven by the driveshaft 120. However, the lubricant pump 134 may alternatively be driven by the crankshaft 42 or an electric motor (not shown). Lubricant from the lubricant pump 134 is directed to a lubricant supply line 136 and is delivered to various portions of the engine which benefit from circulating lubricant. After the lubricant has passed through the various engine galleries, the lubricant collects in the lubricant pan (not shown) provided at a lower end of the crankcase. Lubricant returns to the lubricant reservoir 132 via a return line 138. Thus, the lubrication system 130 defines a loop.

The outboard motor 10 also preferably includes a cooling system for cooling the heated portions of the engine 30, such as the cylinder block 32, the cylinder head assembly 38 and portions of the exhaust system 48. In the illustrated embodiment, a water jacket 140 is defined in the cylinder block 32 and is in thermal communication with the cylinder bores 34. A water pump 142 is driven by the driveshaft 120. Although not shown, a water inlet is provided in the lower unit 26 to draw cooling water from the body of water surrounding the motor 10. The water is supplied to the water jackets through a water supply conduit 144.

As noted above, the ECU 72 controls engine operations including fuel injection from the fuel injectors 88 and firing the spark plugs 116, according to various control maps stored in the ECU 72. In order to determine appropriate control scenarios, the ECU 72 utilizes such maps and/or indices stored within the ECU 72 in reference to data collected from various sensors.

Any type of desired control strategy can be employed for controlling the time and duration of fuel injection from the injectors 88 and the timing of firing the spark plugs 116; however, a general discussion of some engine conditions that can be sensed and some of the ambient conditions that can be sensed for engine control will follow. It is to be understood, however, that those skilled in the art will readily understanding how various control strategies can be employed in conjunction with the components of the invention.

Figure 3:
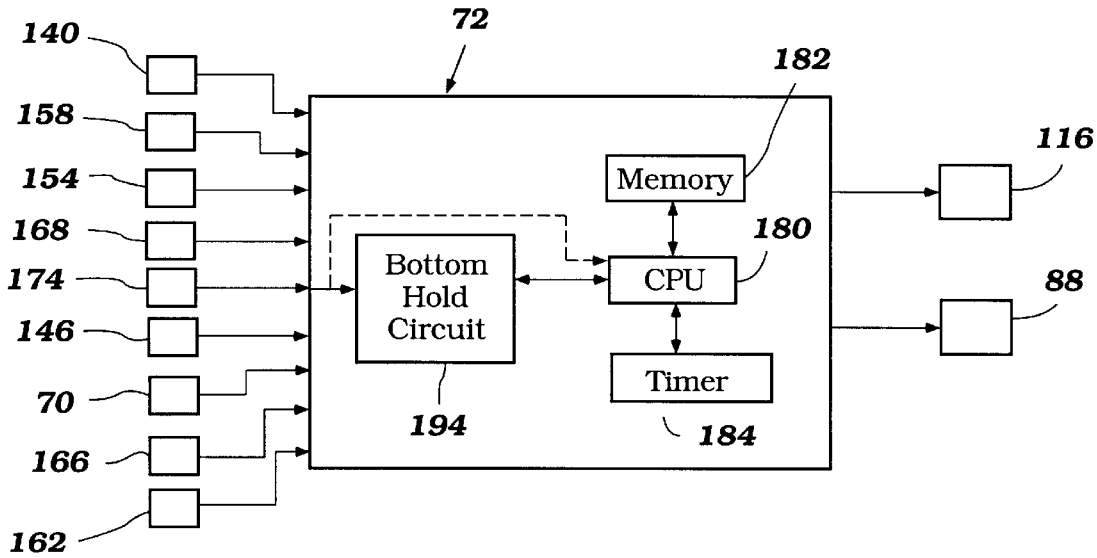
FIG. 3 is a schematic representation of the ECU shown in FIG. 1, having a bottom hold device, receiving input from a number of sensors, and directing output to the sparkplugs and fuel injectors of the engine shown in FIG. 1.

The control for the fuel/air ratio preferably includes a feedback control system. Thus, a combustion condition or oxygen sensor 146 is provided and determines the incylinder combustion conditions by sensing the residual amount of oxygen in the combustion products at about a time when the exhaust port 76 is opened. A data line 147 carries this output signal to the ECU 72, as schematically illustrated in FIGS. 1 and 3.

As shown in FIG. 1, an engine speed sensor 148 measures the crank angle and transmits it to the ECU 72, as schematically indicated. In the illustrated embodiment, the engine speed sensor 148 is in the form of a pulsar coil 150 which is configured to emit a single pulse for each revolution of the crankshaft 42. The signal from the engine speed sensor 148 is transmitted to the ECU 72 via an engine speed data line 152. Engine load, which can be determined by a throttle angle of the throttle valves 64, is sensed by the throttle valve position sensor 70 and is transmitted to the ECU 72 via the throttle position data line 74.

A fuel line pressure sensor (not shown) may be provided which communicates with one of the fuel conduits 108, 110. This pressure sensor can output a high pressure fuel signal to the ECU 72. There also may be provided a trim angle sensor 154 (see the lower portion of FIG. 1) which outputs the trim angle of the outboard motor 10 to the ECU 72, via a trim angle data line 156. Further, an intake air temperature sensor (not shown) may be provided which outputs a temperature signal to the ECU 72.

An atmospheric pressure sensor 158 measures the atmospheric pressure of the ambient air and transmits the signal representing the pressure to the ECU 72, via an atmospheric pressure data line 160. There also may be provided a back pressure sensor (not shown) that outputs exhaust back pressure to the ECU 72.

An engine temperature sensor 162 is connected to the engine block 32 to sense temperature of coolant flowing through the water jacket 140. The engine temperature sensor 162 transmits the temperature of the engine, in terms of the temperature of the coolant flowing through the water cooling jacket 140, via an engine temperature data line 164. An oil pressure sensor 166 and an oil temperature sensor 168 are connected to the lubricant supply line 136 so as to sense engine lubricant pressure and temperature, respectively. The lubricant pressure sensor 166 and the lubricant temperature sensor 168 transmit lubricant pressure and temperature data via a lubricant pressure data line 170 and a lubricant temperature data line 172, respectively. Optionally, the outboard motor 10 may include an alarm system configured to emit an alarm when a pressure and/or a temperature in the lubricant supply line 136 reach undesired levels.

Preferably, an intake air pressure sensor 174 is connected to the intake runner 54 so as to sense an air pressure within the air intake passage 56. The pressure detected by the induction air pressure 174 is transmitted to the ECU 72 by an air pressure data line 176.

The sensed conditions disclosed above are merely some of those conditions which may be sensed for under control and it is, of course, practicable to provide other sensors such as, for example, without limitation, an engine height sensor, a knock sensor, a neutral sensor, a watercraft pitch sensor, and an atmospheric temperature sensor in accordance with various control strategies.

The ECU 72 computes and processes the detection signal of each sensor based on a control map. The ECU 72 forwards control signals to the fuel injectors 88, spark plugs 116, the electromagnetic solenoid valve units which operate the fuel injectors 88, and the fuel pumps 94, 106, for their respective control. Respective control lines that are indicated schematically in FIG. 1 carry out these control signals.

As noted above, the ECU 72 determines the appropriate duration of fuel injection in order to produce a charge with a desired air fuel ratio. Thus, part of the determination of fuel injection duration is based on the induction air pressure sensed by the induction air pressure sensor 174, which is indicative of the mass flow rate of induction air through the induction passage 56. In order to determine a minimum pressure in the induction system, the ECU 72 samples the output of the induction air pressure sensor 174.

With reference to FIG. 3, the construction of the ECU 72 is described in more detail below. As shown in FIG. 3, the ECU 72 includes a CPU 180, a memory 182, and a timer 184. The CPU 180 receives input from the sensors 70, 140, 154, 158, 162, 166, 168, 174 through corresponding communication lines in order to control various characteristics of engine operation, such as, for example but without limitation, the firing of the spark plugs 116 and timing and duration of fuel injection through the fuel injectors 88. The maps noted above, utilized by the ECU 72 for determining the various parameters regarding engine operation, are stored in the memory 182. The CPU 180 interacts with the timer 184 and the memory 182 to process the information gathered from the sensors 70, 140, 146, 154, 162, 168, 174 and generate output to other components of the outboard motor 10 including spark plugs 116 and the fuel injectors 88. It is apparent to one of ordinary skill in the art that the ECU 72 can alternatively be in the form of a hard-wired feedback control system.

During operation of the outboard motor 10, the ECU 72 samples the output from the induction air pressure sensor 174 in order to determine a minimum air pressure in the induction passage 56. In order to minimize the manufacturing cost and complexity of the ECU 72, the ECU 72 desirably is configured to sample the output from the induction air pressure sensor 174 only once for each rotation of the crankshaft 42.

Figure 5:
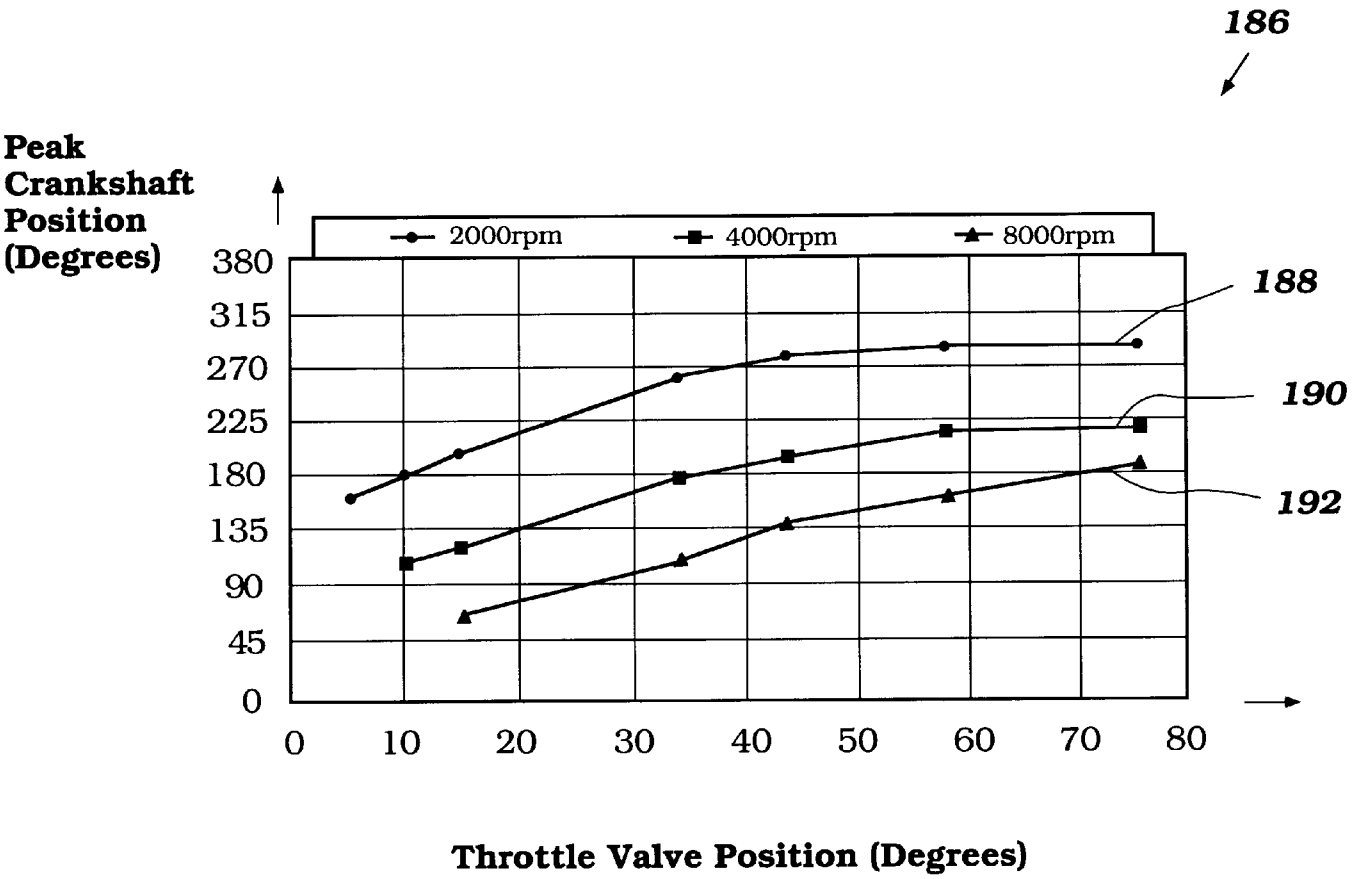
FIG. 5 is a graph representing a map reflecting the relationship between peak positions of the crankshaft included in the engine shown in FIG. 1, along the vertical axis, throttle positions graphed along the horizontal axis, and three curves corresponding to three different engine speeds.

In order to determine the proper timing at which the ECU should sample the induction air pressure sensor 174 so as to coincide with the minimum air pressure generated in the induction passage 56, the memory 182 includes a three-dimensional map 186 illustrated in FIG. 5. The three-dimensional map 186 includes peak crankshaft position plotted on the vertical axis. The peak crankshaft position corresponds to the angular position of the crankshaft 42 at which the minimum pressure is generated within the induction passage 56. The horizontal axis of the map 186 shown in FIG. 5 represents a plurality of values of another engine operation characteristic. In the illustrated embodiment, the horizontal axis represents the angular position of the throttle valve 64 in degrees. Each of the curves 188, 190, 192 illustrates the relationship between throttle valve position and the peak crankshaft position for a particular engine speed. In the illustrated embodiment, the curve 188 represents the relationship between throttle valve position and the peak crankshaft position at an engine speed of 6000 rpm. Similarly, the curve 190 represents this relationship at an engine speed of 4000 rpm and the curve 192 represents this relationship at an engine speed of 2000 rpm.

The data contained in the three-dimensional map 186 shown in FIG. 5 is exemplary of data that can be derived through experimentation for a particular engine. Once the data is determined, it can be stored in a memory of a controller, such as the memory 182 of the ECU 72.

As noted above, one aspect of the present invention includes the realization that the peak crankshaft position for an internal combustion engine predictably varies with the throttle valve position. For example, as illustrated in FIG. 5, the peak crankshaft position for the engine 30 increases as the throttle valve position is increased.

In operation, the ECU 72 refers to the data contained in the three-dimensional map 186 in order to determine the appropriate timing for sampling the induction air pressure sensor 174.

With reference to FIG. 3, the illustrated embodiment of the ECU 72 includes a bottom hold device 194, which is preferably in the form of an electronic circuit. In the illustrated embodiment, the bottom hold device 194 is incorporated into the ECU 72. However, it is apparent to one of ordinary skill in the art that the bottom hold device 172 may be formed separately from the ECU 72.

In the illustrated embodiment, the bottom hold device 194 receives the output from the induction air pressure sensor 174 and provides an output to the CPU 180.

Figure 4:
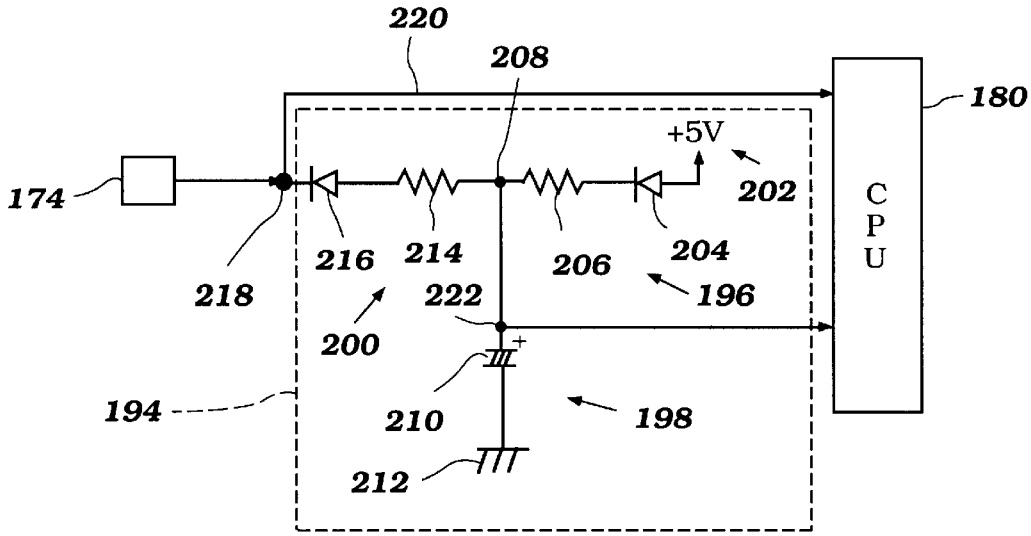
FIG. 4 is a schematic representation of the bottom hold device shown in FIG. 3.

With reference to FIG. 4, the construction of the bottom hold device 194 is described in detail. As shown in FIG. 4, the bottom hold device 194 is an electronic circuit and includes a charging portion 196, a storage portion 198 and a discharge portion 200.

The charging portion 196 of the bottom hold device 194 is connected to a voltage source 202. In the illustrated embodiment, the voltage source is at a potential of approximately +5 volts. The voltage source 202 may be constructed in a number of ways, as is well known in the art. Thus, further description of the voltage source 202 is not necessary for one of ordinary skill in the art to practice the invention.

The charging portion 196 also includes a diode 204 and a resistor 206 connected in series with the voltage source 202. As shown in FIG. 4, the anode of the diode 204 is connected to the voltage source 202 and the cathode of the diode 204 is connected to the resistor 206.

As shown in FIG. 4, the storage portion 198 of the bottom hold device 194 is connected to the charging portion 196 at a node 208. The storage portion 198 includes a capacitor 210 which is arranged with one side connected to the charging portion 196 and the other side connected to ground 212.

The discharge portion 200 is also connected to the node 208. As shown in FIG. 4, the discharge portion 200 includes a resistor 214 and a diode 216 connected in series with the node 208. As shown in FIG. 4, the anode of the diode 216 is connected to the resistor 214 and the cathode of the diode 216 is connected to an input node 218.

In the illustrated embodiment, the CPU 180 is connected to the input node 218 via a raw signal air pressure sensor line 220. Additionally, the CPU 180 is connected to an output node 222 defined between the capacitor 210 and the node 208.

In operation, the bottom hold device 194 receives a fluctuating analog signal from the induction air pressure sensor 174. For example, an exemplary output voltage signal 224 of the air pressure sensor 174 is illustrated in FIG. 6.

With respect to the output signal 224, voltage is plotted on the vertical axis and time is plotted along the horizontal axis. As shown in FIG. 6, the voltage output signal 224 of the induction air pressure sensor 174 fluctuates over time. The fluctuations 228, 229 in the voltage signal 224 illustrated in FIG. 6 correspond to pressure fluctuations in the induction passage 56 (FIG. 1).

During operation of the engine 30, the piston 36 reciprocates within the cylinder bore 34 and the induction valve 60 opens and closes according to the rotation of the intake camshaft 82. During an intake stroke of the piston 36, the piston 36 moves downwardly, as viewed in FIG. 1, within the cylinder bore 34. During at least a portion of the downward movement of the piston 36 within the cylinder bore 34, the intake camshaft 82 causes the intake valve 60 to open, thus allowing the downward movement of the piston 36 to draw air into the combustion chamber 40 through the intake passage 56. As the piston 36 moves downwardly, a partial vacuum is created in the intake passage 56, thus causing he pressure in the intake passage 56 to fall. Accordingly, the output voltage of the induction air pressure sensor 174 also falls. When the induction air within the induction passage 56 stops, the air pressure therein returns roughly to atmospheric pressure, thus causing the output voltage of the induction air pressure sensor to return to the voltage corresponding to approximately the atmospheric pressure.

Figure 6:
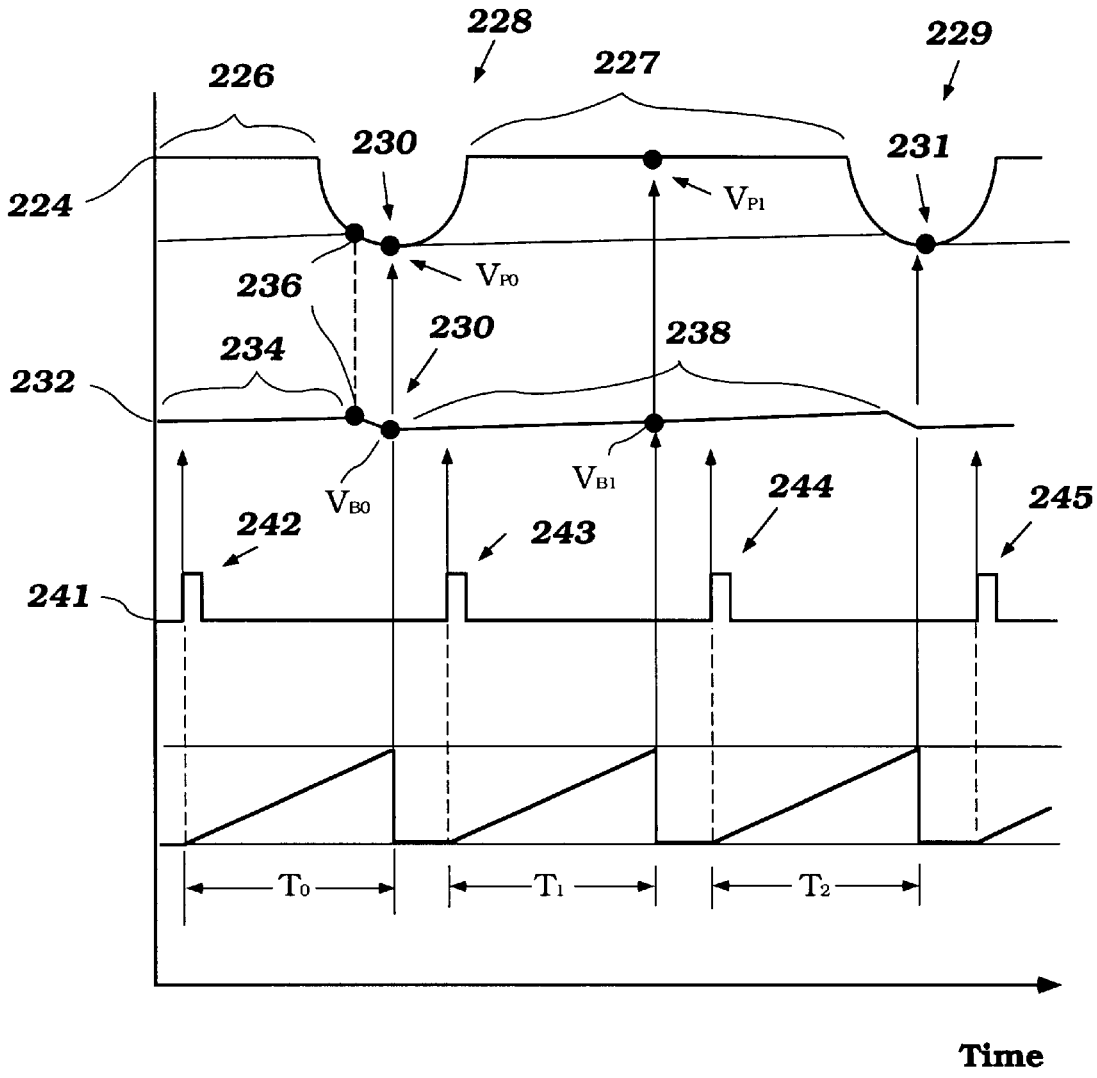
FIG. 6 is a timing diagram illustrating the timing relationship between an output signal of one of the pressure sensors shown in FIG. 2, an output of the bottom hold device shown in FIG. 4, an output signal of a speed sensor shown in FIG. 1, and a pressure sensor sampling timing determined by the ECU shown in FIG. 3.

As shown in FIG. 6, the output voltage signal 224 of the induction air pressure sensor 174 is approximately constant over a time period designated by the reference numeral 226 which corresponds to the period of time when the induction air in the vicinity of the induction air pressure sensor 174 is stationary. The fluctuations 228, 229 in the voltage signal 224 correspond to time periods during which air in the vicinity of the induction air pressure sensor 174 moves. As shown in FIG. 6, the voltage signal 224 reaches minimum values 230, 231 during the fluctuations 228, 229, respectively, which correspond to minimum absolute air pressures in the vicinity of the induction air pressure sensor 174.

As shown in FIG. 4, the voltage output signal 224 is input to the bottom hold device 194. With the fluctuating voltage signal 224 being applied to the node 218 of the bottom hold device 194, the bottom hold device 194 substantially maintains the voltage corresponding to the minimum points 230, 231.

For illustrative purposes, the operation of the bottom hold device 194 is described below with reference to a steady state operation. During a period when the induction air pressure sensor 174 outputs maximum voltage or a voltage corresponding to approximately atmospheric pressure, such as the output illustrated in the areas 226 of FIG. 6, the charging portion 196 of the bottom hold device 194 maintains the node 208 at approximately +5 volts. For example, as shown in FIG. 4, the voltage source 202 is maintained at a potential of +5 volts. Thus, where the output voltage signal 224 of the induction air pressure sensor 174, during the time period 226, is approximately +5 volts, the capacitor 210 is charged to a voltage of +5 volts. However, as the voltage signal 224 enters the fluctuation 228, the voltage at the node 218 drops, thus allowing the voltage at the positive side of the capacitor 210 to fall.

As is apparent to one of ordinary skill in the art, the resistance of the resistor 214 is preferably small so as to allow the voltage of the capacitor to discharge rapidly and follow the falling voltage of the signal 224 during the fluctuation 228. As the voltage signal 224 returns to a maximum voltage or a voltage corresponding to approximately atmospheric pressure, during the period 226, the voltage of the node 218 rises back to +5 volts, thus stopping the discharge of the capacitor 210. With the capacitor 210 in a discharged state, current through the charging portion 196 begins. Accordingly, the charge in the capacitor 210 decays and returns to the voltage of the power source 202. Preferably, the resistance of the resistor 206 is relatively large, thus slowing the charging of the capacitor 210. Thus, the voltage at the node 222 remains at the voltage corresponding to the minimum voltage 230 (FIG. 6) and rises slowly thereafter.

With reference to FIG. 6, an exemplary output voltage of the bottom hold device 194 is indicated generally by the reference numeral 232. As shown in FIG. 6, the voltage at node 222 rises slowly over the time period 234 until the output voltage of the induction air pressure sensor 74 and the voltage at the node 222 become equal, at time 236. As the voltage signal 234 drops below the voltage of node 222, the capacitor 210 further discharges, approximately following the voltage of the voltage signal 224 until the voltage signal 224 reaches the minimum voltage 230. As the voltage signal 224 rises from the minimum voltage 230, the capacitor 210 is recharged by the charging portion 196, thus causing the voltage maintained by the capacitor 210 to decay. As noted above, since the resistor 206 is desirably relatively large, the capacitor 210 charges slowly over the time period 238.

As noted above, the ECU 72 is preferably configured to sample the voltage signal 224 when the voltage signal 224 is at the minimum voltage 230. However, even if the timing of the ECU sampling described below in detail does not coincide with the minimum voltage 230, the ECU 72 can sample the output voltage of the bottom hold device, which thereby allows the ECU 72 to receive a signal at least approximately equal to the minimum voltage 230.

Figure 7:
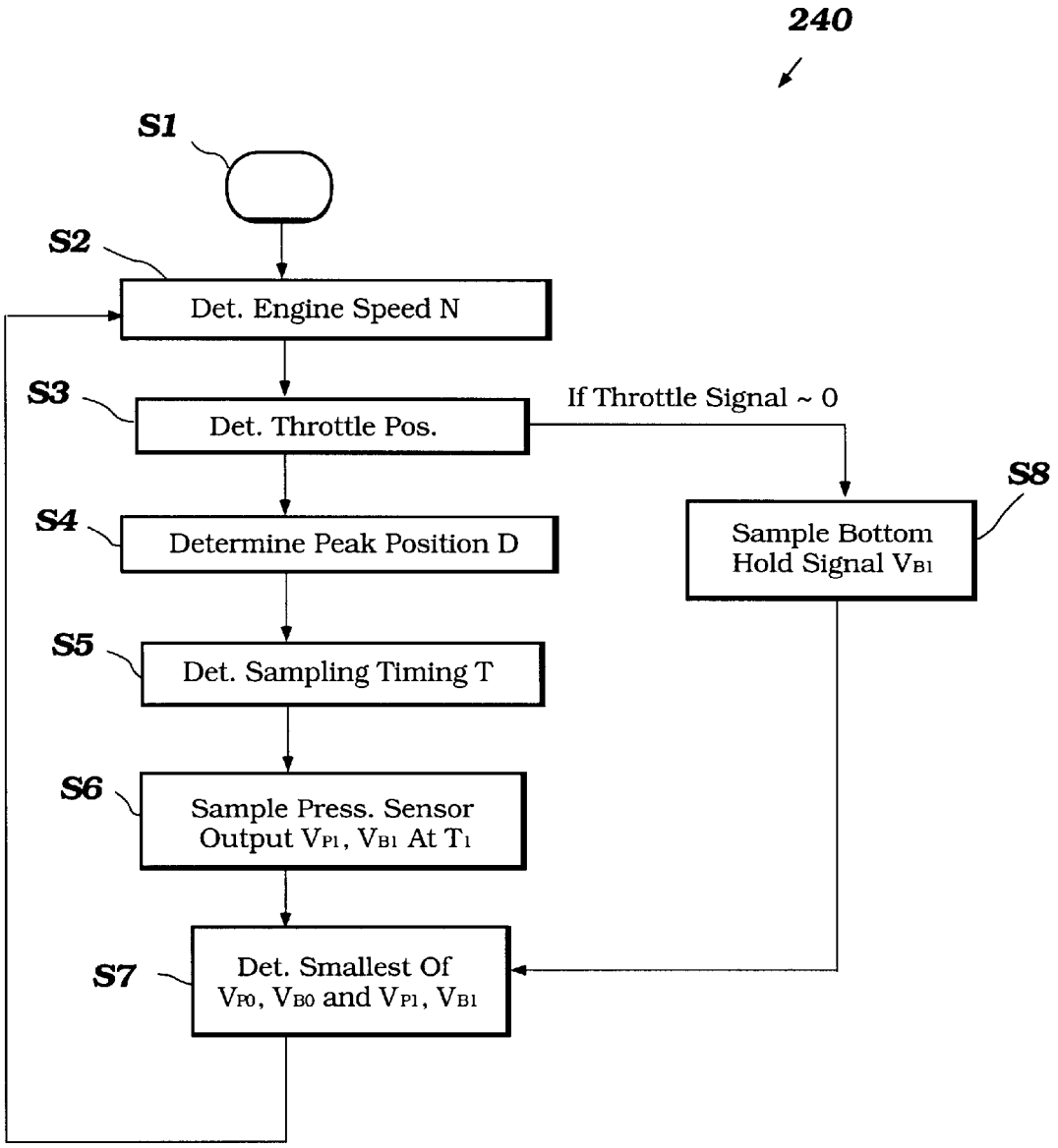
FIG. 7 is a flow diagram of a pressure sensor sampling control routine.

FIG. 7 illustrates a control subroutine for sampling the output signal of the induction air pressure sensor 174 according to the present invention. The control subroutine 240 can begin at step S1, when the engine 30 is running and/or when electrical power is first provided to the ECU 72. After the control subroutine 240 has been initiated, the program moves to a step S2.

At the step S2, the ECU 72 determines the engine speed. For example, the ECU 72 may receive a signal from the engine speed sensor 148, or from a translator which translates the signal from the engine speed sensor 148 into another signal for further processing by the ECU 72. For example, the engine speed N can be determined by counting a number of engine revolutions and averaging the number of revolutions over time to determine the engine speed in terms of revolutions per minute. After the ECU 72 has determined the engine speed, the subroutine 240 moves on to a step S3.

At the step S3, the ECU determines the throttle position. For example, the ECU 72 can sample the voltage output signal from the throttle position sensor 70, in order to determine the angle of the throttle position. After the throttle position has been determined, the control subroutine moves onto the step S4.

At the Step S4, the peak position of the crankshaft is determined. As noted above, the peak position of the crankshaft is the position of the crankshaft when the air pressure in the induction passage 56 in the vicinity of the induction air pressure sensor 174 reaches a minimum value. This information is predetermined and stored in a three-dimensional map, such as the three-dimensional map 186 illustrated in FIG. 5. In the illustrated embodiment, in order to determine the peak position of the crankshaft, the ECU 72 identifies the peak crankshaft position according to the engine speed in Step S2 and the throttle position determined in Step S3. As shown in FIG. 7, the peak position is identified as the letter "D." In the illustrated embodiment, the peak crankshaft position is in the units of degrees. After the peak crankshaft position has been determined, the control routine 240 moves on to a Step S5.

At the Step S5, a sampling timing T is determined. The sampling timing T, which is expressed as seconds in the illustrated embodiment, corresponds to the time required for the crankshaft to reach the peak position D from the generation of a pulse signal from the engine speed sensor 148. In the illustrated embodiment, the engine speed sensor 148 outputs a single pulse when a crankshaft reaches zero degrees. Thus, the sampling timing is calculated as follows:

$$T=D\times 60\div(360\times N),$$

where N is engine speed in revolutions per minute, D is peak crankshaft position in degrees, and T is the desired sampling timing in seconds. After the sampling timing T has been determined, the subroutine 240 moves on to a Step S6.

At the Step S6, the output of the induction air pressure sensor 174 sampled at the sampling timing T. In the illustrated embodiment, the timer 184 clocks the time from a pulse signal from the engine speed sensor 148 until the sampling timing T has elapsed. Once the sampling timing period T has elapsed, the ECU 72 samples the output voltage of the induction air pressure sensor 174. As shown in FIGS. 3 and 4, the ECU 72 can sample the voltage output directly via the data line 220 or via the bottom hold device 194 by sampling the voltage at node 222. After the output of the induction air pressure sensor 174 has been sampled, subroutine 240 moves on to a Step S7.

At the Step S7, the voltage $V_{p1}$,, $V_{B1}$ sampled in the Step S6 is compared to a previously sampled voltage $V_{P0}$, $V_{B0}$. The smallest of the present signal $V_{P1}$, $V_{B1}$ and the previous signal $V_{P0}$, $V_{B0}$ is determined as the minimum induction air pressure signal, and is thus used by the ECU 72 to further determine fuel injection duration. After the Step S7, the subroutine returns to the Step S2 and repeats.

Optionally, the routine 240 may include a Step S8 following the Step S3. If, at the Step S3, it is determined that the signal from the throttle position sensor 70 is substantially zero volts, it is assumed that the throttle position sensor 70 is not operating properly, and the routine moves on to the Step S8.

At the Step S8, the output of the bottom hold device 194 is sampled. For example, as shown in FIG. 4, the CPU 180 of the ECU 72 can sample the voltage at node 222. After the present signal $V_{B1}$ of the bottom hold device 194 sample, the routine 240 moves on to the Step S7.

At the Step S7, the present sample signal $V_{B1}$ sampled at the Step S8 is compared to a previously sampled signal $V_{P0}$ directly from the induction air pressure sensor 174, or previously sampled signal $V_{B0}$ from the bottom hold device 194. At the Step S7, as noted above, the smallest of the two compared signals $V_{B1}$ and $V_{P0}$, $V_{B0}$ is determined as the minimum signal corresponding to the minimum air pressure in the induction passage 56 in the vicinity of the induction air pressure sensor 174.

With reference to FIG. 6, timing of the sampling performed during the routine 240 will now be described in further detail. As shown in FIG. 6, the sampling timing T determined in the Step S5 (FIG. 7) is indicated in the lower portion of the graph illustrated in FIG. 6. Additionally, an output signal 241 of the engine speed sensor 148 is illustrated below the output voltage signal 232 of the bottom hold device 194. As shown in FIG. 6, the output signal 241 of the engine speed sensor 148 is in the form of pulses, one pulse 242, 243, 244, 245 for each rotation of the crankshaft 42. As noted above, with reference to Step S5, the sampling timing T is determined as a function of the peak crankshaft position D determined in this Step S4 and the engine speed N determined in the Step S2. As noted above, the sampling timing T is determined in units of time, i.e., seconds to be measured from the detection of an output pulse 242, 243, 244, 245 from the engine speed sensor 148. Thus, each output pulse 242, 243, 244, 245 illustrated in FIG. 6 corresponds to a time at which the crankshaft 42 rotates past zero degrees or "top dead center."

As shown in FIG. 6, when the output pulse 242 is received by the ECU 72, the timer 184 (FIG. 3) begins. In the illustrated embodiment, the timer 184 is in the form of counter which begins counting when the pulse 242 is received by the ECU 72. When the counter reaches the value corresponding to the sampling timing T, the ECU 72 samples the voltage $V_{P1}$ directly from the induction air pressure sensor 174 or the voltage $V_{B1}$ from the node 222 of the bottom hold device 194. As shown in FIG. 6, by sampling the voltage $V_{P1}$,$V_{B1}$ at the timing T, the ECU 72 can accurately sample the output signal 224 of the induction air pressure sensor 224 at the time at which the signal 224 reaches the minimum point 230.

As noted above, the engine 30 is a four-cycle type engine. Thus, the induction valve 60 opens only once for every two revolutions of the crankshaft 42. Thus, there is only one fluctuation 228, 229 in the voltage signal 224 for every two revolutions of the crankshaft 42, and thus, for every two pulses of the output signal 240 of the engine speed sensor 148. Thus, when the output signal 224, 232 is sampled after the sampling timing T1 has elapsed, as illustrated in FIG. 6, yielding the voltages $V_{P1}$ and $V_{B1}$, the sampled voltage $V_{P1}$, $V_{B1}$ compared with the voltage sampled at the end of the previous sampling timing $T_0$, i.e., $V_{P0}$, $V_{B0}$. In the illustrated example, the voltages $V_{P0}$, $V_{B0}$ are smaller than the corresponding voltages $V_{P1}$, $V_{B1}$. Thus, the voltage $V_{P0}$, $V_{B0}$ are determined as the voltage corresponding to the minimum air pressure and the induction air passage 56, and are further used by the ECU 72 to determine the proper fuel injection duration.

With reference to FIG. 8, a two-dimensional map 246 is illustrated therein for use with a modification of the embodiment illustrated in FIGS. 1–7. As shown in FIG. 8, the two-dimensional map 246 includes data regarding two engine operation characteristics. In the illustrated embodiment, the first engine operation characteristic 247 is engine speed ($N_X$), and the second engine operation characteristic 248 is peak crankshaft position ($D_X$). The two-dimensional map 246 is used in combination with the ECU 72 illustrated in FIG. 3. However, in the present modification of the embodiment of FIGS. 1–7, the ECU 72 can include the two-dimensional map 246 in the memory 182 and can omit the bottom hold device 194. A method of operation of the ECU 72 as such, is described below with respect to FIG. 9.

Figure 9:
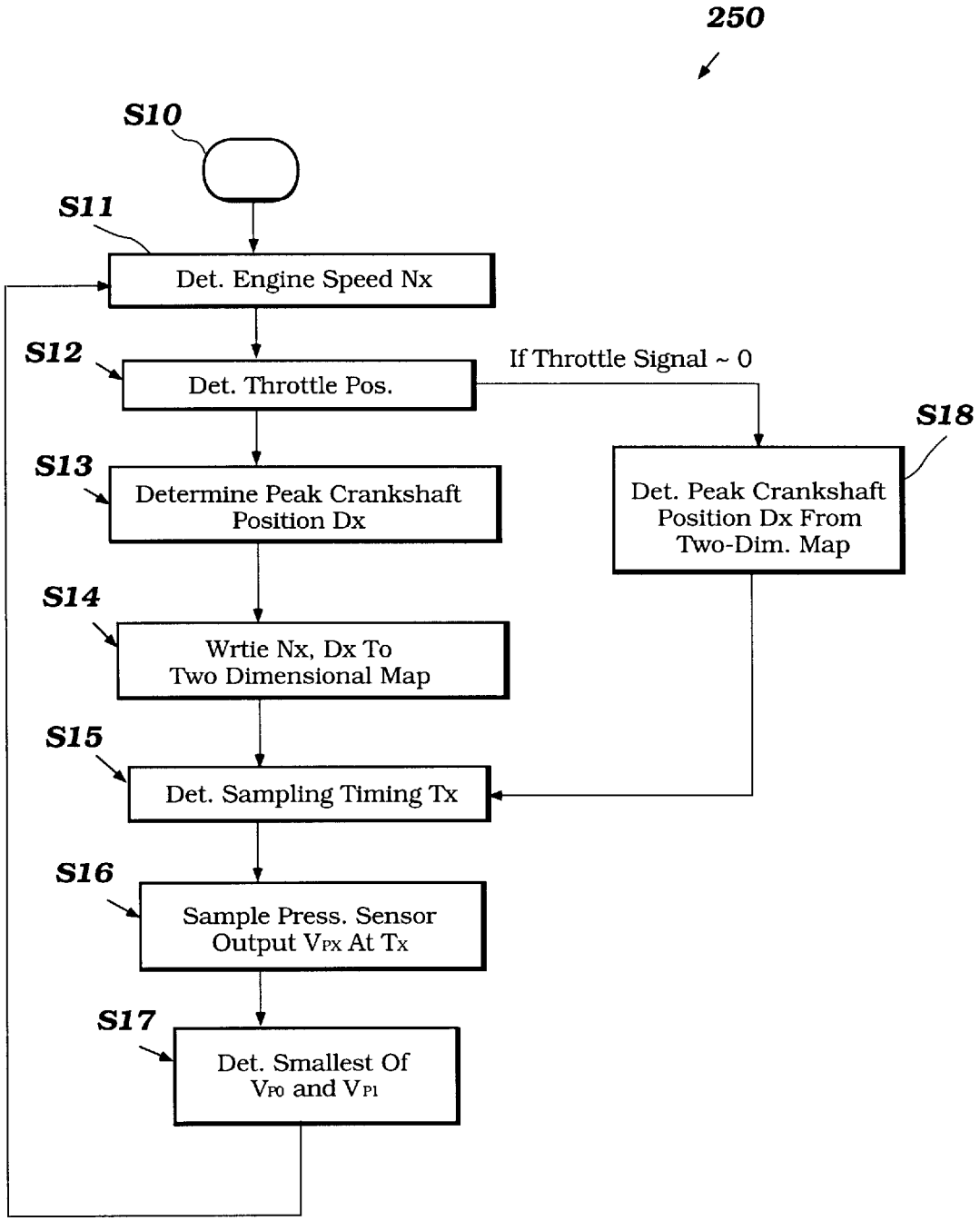
FIG. 9 is a flow diagram of a modification of the pressure sensor sampling control routine shown in FIG. 7.

FIG. 9 illustrates a control routine 250 for sampling the output of the induction air pressure sensor 174 in accordance with a modification of the routine 240. The control routine 250 is initiated at Step S10. After the routine 250 has been initiated, the routine 250 moves on to Step S11 where the engine speed N is determined. As noted above, with reference to Step S2 illustrated in FIG. 7, the engine speed N may be determined by counting a number of engine revolutions and averaging over time to determine engine speed in terms of revolutions per minute. After the engine speed $N_x$ is determined, the routine 250 moves on to a Step S12.

At the Step S12, the throttle position is determined. For example, the ECU 72 may sample an output of the throttle valve position sensor 70. After the throttle valve position has been determined, the routine 250 moves on to a Step S13.

In the Step S13, the peak crankshaft position $D_x$ is determined. For example, as described above with respect to Step S4 illustrated in FIG. 7, the ECU 72 can determine the peak crankshaft position $D_x$ using the engine speed determined in Step S11 and the throttle position determined in Step S12 to find the corresponding peak crankshaft position $D_x$ according to the three-dimensional map 186 illustrated in FIG. 5. After the peak crankshaft position $D_x$ has been determined, the subroutine 250 moves on to a Step S14.

In Step S14, the engine speed $N_X$ determined in the Step S11 and the peak crankshaft position $D_X$ determined in the Step S13 are written to the two-dimensional map shown in FIG. 8. As the routine 250 is repeated, the two-dimensional map 244 stores a plurality of engine speeds $N_X$ with a corresponding plurality of peak crankshaft positions $D_X$. In the illustrated example of the two-dimensional 244 illustrated in FIG. 8, the two-dimensional map 244 includes a first column having a number of sequential engine speeds $N_1$–$N_n$ and a second column having peak crankshaft positions $D_1$–$D_n$. After the present engine speed $N_x$ and peak crankshaft position $D_x$ are written to the two-dimensional 244, the routine 250 moves on to a Step S15.

At the step S15, the sampling timing T is determined. As described above with respect to step S5 illustrated in FIG. 7, the sampling timing $T_x$ can be determined according to the engine speed and $N_x$ determined in the step S11 and the peak crankshaft position $D_x$ determined in the step S13. In the illustrated embodiment, the sampling timing $T_x$ in units of seconds, is determined by the following formula:

$$T_x = D_x \times 60/(360 \times M_x),$$

where $D_x$ is the present peak crankshaft position and where $N_x$ is the present engine speed. After the sampling timing $T_x$ has been determined, the routine 250 moves onto a step S16.

At the step S16, the output of the induction air pressure sensor 174 sampled according to the sampling timing $T_x$ determined in the step S15. The sampling carried out in the step S16 can be performed as disclosed above with reference to the step S6 illustrated in FIG. 7 and the timing illustrated in FIG. 6. However, as noted above, the routine 250 can be performed without the bottom hold device 194. Thus, the sampling carried out in the step S16 may be performed by the ECU 72 sampling the voltage output 224 of the induction air pressure sensor 174. After the output of the induction air pressure sensor 174 has been sampled, the routine 250 moves on to a step S17.

At the step S17, the present sampling value $V_{PX}$ of the induction air pressure sensor 174 sampled during the step S16, is compared with a previously sampled output of the induction air pressure sensor 174. For example, similar to the comparison performed in the step S7 illustrated in FIG. 7, a present sample $V_{P1}$ is compared with a previous sample $V_{P0}$. The smallest of the samples $V_{P1}$, $V_{P0}$ is determined to reflect the minimum air pressure in the vicinity of the air pressure sensor 174, and is thus used by the ECU 72 to determine fuel injection duration.

Optionally, the routine 250 may include a step S18. For example, if, at the step S12, it is determined that the output of the throttle position sensor 70 is substantially zero, it is assumed that the throttle position sensor 70 is not operational, and thus the routine 250 moves to the step S18.

At the step S18, the peak crankshaft position $D_x$ is determined based on the two-dimensional map illustrated in FIG. 8. For example, at the step S18, the ECU 72 may determined the likely peak crankshaft position $D_x$ by using the present engine speed $N_x$ and finding a corresponding engine speed stored in the first column 247 of the two-dimensional map 246 illustrated in FIG. 8: Thus, the present peak crankshaft position $D_x$ can be assumed to be approximately the peak crankshaft position $D_n$ in the column 248 corresponding to the engine speed which is approximately equal to the present engine speed $N_x$ in column 246 of the twodimensional map 246. After the peak crankshaft position $D_x$ is determined in the step S18, the routine moves to the steps S15–S17 and returns to the step S11, and repeats.

Figure 10:
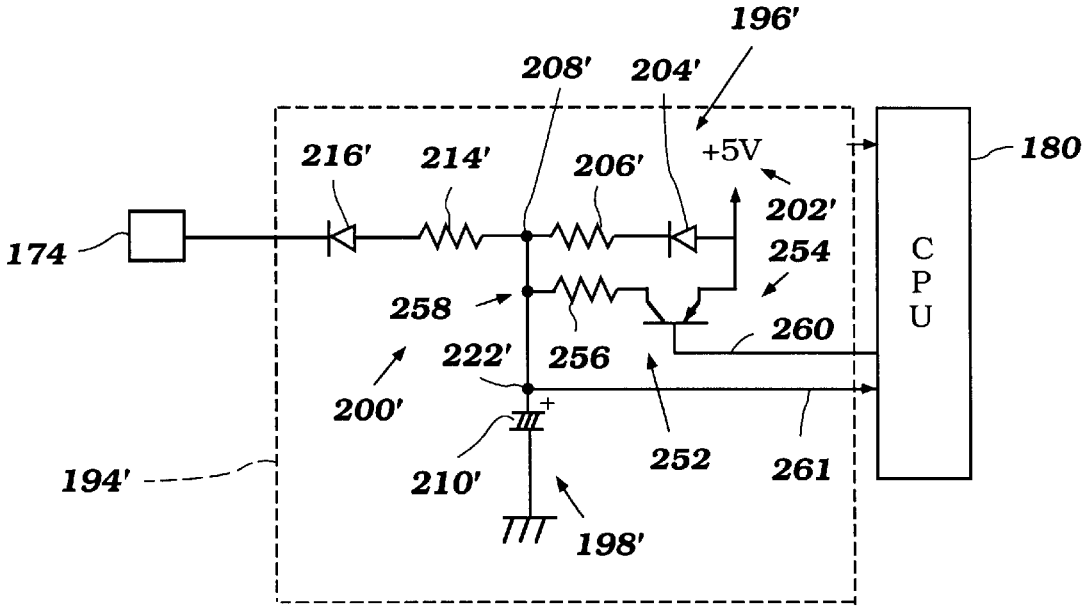
FIG. 10 is a modification of the bottom hold device illustrated in FIG. 4.
Figure 11:
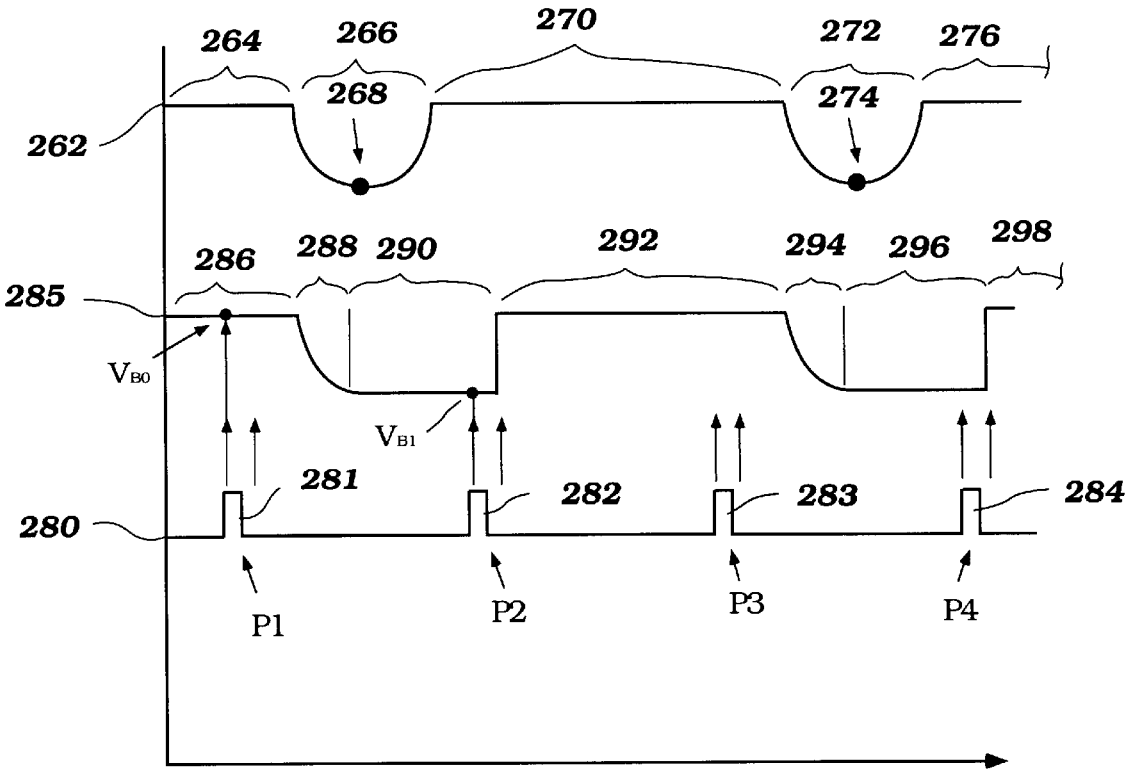
FIG. 11 is a timing diagram illustrating a timing relationship between an output of one of the pressure sensors shown in FIG. 2, and output of the bottom hold device shown in FIG. 10, and an output of the engine speed sensor shown in FIG. 1.
Figure 12:
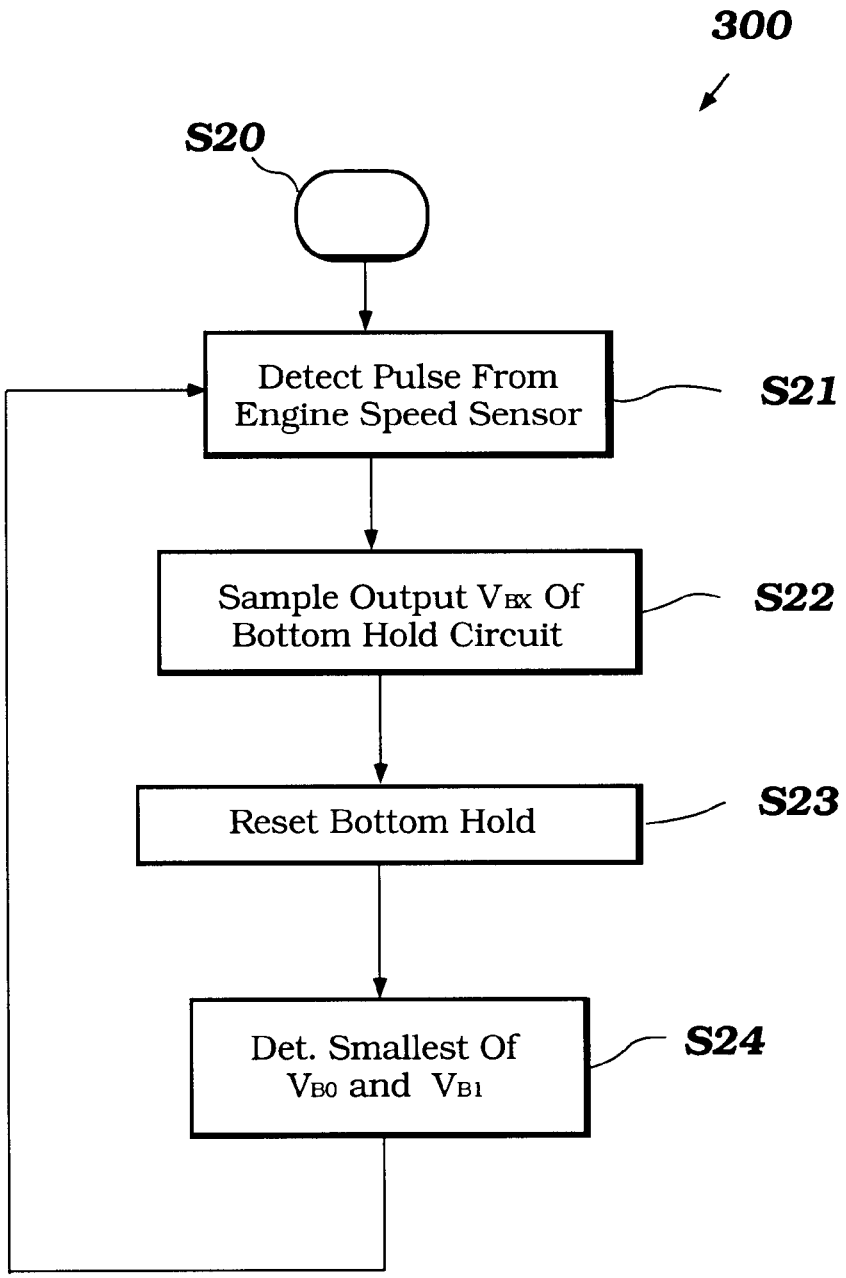
FIG. 12 is a flow diagram of a further modification of the air pressure sensor sampling control routine shown in FIG. 7.

With reference to FIGS. 10–12, a further modification of the embodiment shown in FIGS. 1–7 is illustrated therein. With initial reference to FIG. 10, a modification of the bottom hold device 194 illustrated in FIG. 4 is identified generally by the reference numeral 194'. The construction of the bottom hold device 194' is similar to the construction of the bottom hold device 194, and thus, corresponding components in the bottom hold device 194' illustrated in FIG. 10 are identified with identical reference numerals used in the bottom hold device 194, except that a "'" has been added.

As shown in FIG. 10, the bottom hold device 194' includes a charging portion 196', a storage portion 198' and a discharge portion 200' which can be constructed identically to the charging portion 196, the storage portion 198, and the discharge portion 200 illustrated in FIG. 4. Thus, a further description of these components is not necessary for one of ordinary skill in the art to practice the invention.

The bottom hold device 194' illustrated in FIG. 10 differs from the bottom hold device 194 in that the bottom hold device 194' includes a reset portion 252.

As shown in FIG. 10, the reset portion 252 of the bottom hold device 194' includes a transistor 254 connected to the power source 202' in series with a resistor 256. The emitter of the transistor 254 is connected to the power source 202' and the collector is connected to the resistor 256, which is connected to a node 258. The node 258 is also connected to the nodes 208', 222', and thus, is at the same potential. The base of the transistor 254 is connected to the CPU 180 via a reset data line 260. Constructed as such, the bottom hold device 194' may be reset by triggering the reset portion 252. In the illustrated embodiment, the CPU 180 of the ECU 72 can trigger the reset portion 252 and thereby charge the capacitor 210' to a voltage of +5 volts.

With reference to FIG. 11, the operation of the bottom hold device 194' will be described in more detail.

FIG. 11 illustrates, at its upper portion, an illustrative sample of a voltage output 262 from the induction air pressure sensor 174. As shown in FIG. 11, moving from left to right, the voltage signal 262 is initially substantially flat, indicating that the induction air within the induction air passage 56 in the vicinity of the induction air pressure sensor 174 is relatively stable, this flat section is identified generally by the reference numeral 264. Following the portion 264, a fluctuation 266 is output from the pressure sensor 174 when induction air in the vicinity of the sensor 174 moves. As shown in FIG. 11, as the induction air moves past the pressure sensor 174, the voltage output reaches a minimum value 268 which corresponds to a minimum absolute air pressure within the induction air passage 56 in the vicinity of the pressure sensor 174. Following the fluctuation 266, when the air in the vicinity of the sensor 174 returns to a substantially static state, the voltage output signal 262 of the sensor 174 is uniform over the period 270. Similarly, after the period 270, a second fluctuation 272 follows as the air in the vicinity of the pressure sensor 174 moves again, reaching a minimum voltage signal 274. After the fluctuation 272, the voltage signal 262 returns to a uniform output during the period 276. As noted above with reference to the voltage output signal 224 described in FIG. 6, the fluctuations 266, 272 occur only once for every two revolutions of the crankshaft 242, because the engine 30 is a four-cycle type engine.

As shown in the lower portion of FIG. 11, an output signal 280 of the engine speed sensor 148 includes a single pulse 281, 282, 283, 284 for each rotation of the crankshaft 242. Thus, there are two pulses for each fluctuation 266, 272 of the voltage signal 262.

FIG. 11 also illustrates a voltage output signal 285 of the bottom hold device 194'. In the illustrated embodiment, the voltage output signal 285 represents the voltage transmitted to the CPU from the bottom hold device 194' from the node 222'. As shown in FIG. 11, immediately prior to the fluctuation 266, the output signal 284 generally follows the voltage signal 262 over the portion 286. As the voltage signal 262 drops during the fluctuation 266, the signal 285 of the bottom hold device follows the voltage of the output signal 262 over the portion 288. Once the voltage signal 262 reaches the minimum value 268, the bottom hold device 194' maintains the minimum voltage over the holding portion 290 of the output signal 284. Following the portion 290, the bottom hold device 194' can be reset so as to allow the voltage of the capacitor 210' to return to the fully charged voltage, as represented by the portion 292. Similarly, the output signal 284 of the bottom hold device 194' follows the voltage of the pressure sensor output signal 262 as it drops during the fluctuation 272 over the portion 294. The bottom hold device 194' then maintains the minimum. The minimum voltage over the holding portion 296, then resets over the portion 298.

FIG. 12 illustrates a control routine 300 for sampling the output of the bottom hold device 194' in accordance with a modification of the routine 240. The control routine 300 is initiated at step S20. After the routine 300 is initiated, the routine 300 moves on to a step S21.

At the step S21, pulses are detected from the engine speed sensor 148. For example, the ECU 72 can detect the pulse 281 (FIG. 11) in the output signal 280 of the engine speed sensor 148. When an output pulse is detected, the routine moves on to a step S22.

In the step S22, the output signal 284 of the bottom hold device 194' is sampled. For example, as shown in FIG. 10, the ECU is connected to the node 222' via the bottom hold data line 261. Thus, the CPU 180 can sample the voltage at the node 222' via the data line 261. Once the output $V_B$ is sampled in the step S22, the routine 300 moves on to a step S23.

At the step S23, the bottom hold device 194' is reset. For example, with reference to FIG. 10, the CPU 180 can signal the transistor 254 via the reset data line 260. When the CPU 180 turns on the transistor 254, current flows from the power source 202' through the transistor 254 and the resistor 256 into the capacitor 210', thus charging the capacitor 210' to the voltage source 202' potential. In the illustrated embodiment, as noted above, the power source 202' is at a potential of +5 volts. Thus, it is desirable to set the resistance of the resistor 256 to a relatively small resistance, thus allowing the capacitor 210' to charge quickly when the CPU 180 signals the transistor 254. After the bottom hold device 194' has been reset, the routine 300 moves on to a step S24.

At the step S24, the value of the sampled output obtained in the step S22 is compared to a previously sampled output of the bottom hold device 194'. For example, the ECU 72 compares a present voltage output $V_{B1}$ with a previously sampled voltage output $V_{B0}$ from the bottom hold device 194', and determines which is the smallest. The smallest value is assumed to correspond to the minimum air pressure in the induction passage 56 in the vicinity of the induction air pressure sensor 174. The minimum value is thus further used by the ECU 72 to determine fuel injection duration. After the smallest value of the sampled voltage output is determined, the routine 300 returns to the step S21 and repeats.

The timing of the sampling performed in the routine 300 will be further described with reference to FIG. 11. As shown in FIG. 11, the pulses 281, 282, 283, 284 of the engine speed sensor output 280 are labeled as P1, P2, P3, P4. At the pulse P1, the output signals 262, 284 are at a maximum voltage, which corresponds to a state where the air in the vicinity of the induction air pressure sensor 174 is substantially stopped. At the issuance of the pulse P1, the output signal 284 is sampled by the ECU 72. The sampled voltage is indicated generally by the reference numeral $V_{B0}$. Following sampling of the signal 284, the ECU 180 signals the transistor 254 to turn on, thus resetting the bottom hold device 194' . Since the output signal 284 of the bottom hold device 194' is at the maximum value, the reset signal does not change the voltage output signal 284.

At the next rotation of the crankshaft 42, the engine speed sensor 148 issues the pulse P2. When the pulse P2 is sensed by the ECU 72, the voltage output signal 284 is sampled by the CPU 180. As shown in FIG. 11, the output signal 284 is at a voltage $V_{B1}$ when the signal 284 is sampled at the pulse P2. As shown in FIG. 11, the sample voltage $V_{B0}$ is greater than the voltage $V_{B1}$. Additionally, the voltage $V_{B1}$ is approximately identical to the minimum voltage reached by the bottom hold device 194' when the output signal 262 of the pressure sensor 174 reached the minimum value 268. Thus, the sample value $V_{B1}$ is close to or is identical to the minimum voltage 268, and thus represents an accurate sampling of the minimum voltage output by the pressure sensor 174. Thus, the resistance of the resistor 206' is preferably very large, and may approach infinity, thus preventing the capacitor 210' from charging while the bottom hold device 194' is in the holding state.

After the output signal 284' has been sampled by the ECU 72, the CPU 180 signals the transistor 254 via the reset signal line 260 to charge the capacitor 210' and thus reset the bottom hold device 194'. As shown in FIG. 11, when the bottom hold device 194' is reset after the sampling of the voltage $V_{B1}$, the voltage jumps substantially immediately to the maximum voltage of the signal 284.

As noted above with reference to step S24 illustrated in FIG. 12, the ECU 72 then compares the voltages $V_{B0}$ and $V_{B1}$ to determine which is the smallest. In the illustrated example, the voltage $V_{B1}$ is the smallest voltage, and is thus assumed to represent the minimum voltage output of the pressure sensor 174. Thus, the ECU 72 uses the voltage $V_{B1}$ for further determining fuel injection duration to achieve the desired air fuel ratio.

By constructing the bottom hold device 194' with a reset portion 252', the resistance of the resistor 206' can be made so large that the voltage at the node 222' remains substantially uniform over the holding period 290, 296 without decaying. Thus, although the routine 300 illustrated in FIG. 12 does not require the ECU 72 to determine the peak crankshaft position, the ECU 72 can determine the minimum voltage output of the pressure sensor 174, while sampling the output of the sensor 174 only once per rotation of the crankshaft 42. Thus, the complexity of the ECU 72 can be minimized while achieving accurate determination of the minimum pressure in the vicinity of the pressure sensor 174 and the corresponding accuracy of the mass flow rate of air through the induction passages.

Of course, the foregoing description is that of certain features, aspects and advantages of the present invention to which various changes and modifications may be made without departing from the spirit and scope of the present invention. Moreover, an outboard motor may not feature all objects and advantages discussed above to use certain features, aspects and advantages of the present invention. Thus, for example, those skilled in the art will recognize that the invention may be embodied or carried out in the manner that achieves or optimizes one advantage or a group of advantages as taught herein without necessarily achieving other objects or advantages as may be taught or suggested herein. The present invention, therefore, should only be defined by the appended claims.

What is claimed is:

1. A engine comprising an engine body defining at least one combustion chamber therein, a crankshaft rotatably journaled at least partially within the engine body, an induction system configured to guide induction air into the combustion chamber, a pressure sensor configured to detect a pressure in the induction system and to output a signal indicative of the pressure detected, a charge former configured to supply a fuel charge to the combustion chamber, an engine speed sensor configured to detect rotation of the crankshaft, a memory containing data regarding a relationship between a plurality of peak positions of the crankshaft, a plurality of engine speeds, and a plurality of values of an engine operation characteristic other than engine speed, wherein the peak positions correspond to a position of the crankshaft when an induction air pressure in the induction system is at a substantially minimum value, and a controller configured to sample the output from the pressure sensor when the crankshaft is approximately at the peak position.

2. The engine according to claim 1, wherein the controller is configured to sample the output from the pressure sensor only once per rotation of the crankshaft.

3. The engine according to claim 1 additionally comprising a throttle valve controlling a flow of air through the induction system and a throttle valve position sensor configured to sense a position of the throttle valve and to output a signal indicative of the position detected, and wherein the engine operation characteristic is the position of the throttle valve.

4. The engine according to claim 3 additionally comprising a bottom hold device configured to substantially maintain a minimum value of the output of the pressure sensor.

5. The engine according to claim 4, wherein the controller is configured sample the output of the throttle position sensor, and to sample the output of the bottom hold device regardless of the peak crankshaft position indicated by the memory, if the output of the throttle position sensor is substantially zero.

6. The engine according to claim 4, wherein the bottom hold device comprises a charging portion, a storage portion, and a discharge portion.

7. The engine according to claim 6, wherein the charging portion biases the storage portion to a maximum voltage, the discharge portion being connected to the pressure sensor.

8. The engine according to claim 7, wherein the discharge portion has a resistance that is less than a resistance of the charging portion.

9. The engine according to claim 1, wherein the controller is configured such that if a first pressure detected by the pressure sensor is less than a previous pressure detected by the pressure sensor, the controller uses the first pressure as a regular peak value of the induction air pressure.

10. The engine according to claim 1 additionally comprising at least a one valve controlling a fluid flow through the combustion chamber and at least one cam shaft actuating the valve, wherein the controller is configured to determine a rotational position of the cam shaft by comparing a first pressure data received form the pressure sensor with a previous pressure data received from the pressure sensor.

11. The engine according to claim 1 additionally comprising a bottom hold device configured to substantially maintain a minimum value of the output of the air pressure sensor.

12. The engine according to claim 1 additionally comprising a second memory location, wherein the controller is configured to write an engine speed detected by the engine speed sensor and a corresponding peak crankshaft position to the second memory.

13. The engine according to claim 12, wherein the controller is configured to write the engine speed and the peak crankshaft position to the second memory for each rotation of the crankshaft.

14. The engine according to claim 12 additionally comprising a throttle valve controlling a flow of air through the induction system, a throttle valve position sensor configured to detect a position of the throttle valve and to output a signal indicative of the position detected, wherein the throttle valve position is the engine operation characteristic, the controller being configured to determine the peak crankshaft position from the second memory if the output of the throttle valve position sensor is substantially zero.

15. An engine comprising an engine body defining at least one combustion chamber therein, a crankshaft rotatably journaled at least partially within the engine body, an induction system configured to guide induction air into the combustion chamber, a pressure sensor configured to detect a pressure in the induction system and to output a signal indicative of the pressure detected, a charge former configured to supply a fuel charge to the combustion chamber, a bottom hold device configured to output and substantially maintain a value indicative of a minimum output value of the pressure sensor, and a controller configured to sample the output from the bottom hold device.

16. The engine according to claim 15, wherein the bottom hold device additionally comprises a reset portion configured to selectively reset the output signal of the bottom hold device to a reset value.

17. The engine according to claim 16, wherein the controller is configured to selectively output a reset signal to the bottom hold device.

18. The engine according to claim 17, wherein the controller is configured to output the reset signal after sampling the pressure sensor.

19. The engine according to claim 15, wherein the bottom hold device is configured to maintain the signal indicative of the minimum output of the pressure sensor such that the signal does not substantially decay between a peak crankshaft position and the sampling of the bottom hold device by the controller.

20. The engine according to claim 15, wherein the bottom hold device comprises a charging portion, a storage portion, and a discharge portion.

21. The engine according to claim 20, wherein the charging portion biases the storage portion to a maximum voltage, the discharge portion being connected to the pressure sensor.

22. The engine according to claim 21, wherein the bottom hold device additionally comprises a reset portion comprising transistor connected between the storage portion and the charging portion such that a reset value is the maximum voltage.

23. The engine according to claim 22, wherein the base of the transistor is connected to the controller.

24. The engine according to claim 20, wherein the charging portion is configured such that the value maintained by the bottom hold device does not decay.

25. The engine according to claim 20, wherein the discharge portion has a resistance that is less than a resistance of the charging portion.

26. A method for controlling the operation of an engine having an engine body, at least one combustion chamber defined in the body, a crankshaft journaled for rotation at least partially within the engine body, an induction system configured to guide induction air into the combustion chamber, and an induction air pressure sensor configured to detect a pressure in the induction system, the method comprising determining a rotational speed of the crankshaft, determining a peak crankshaft position based on the rotational speed and the value of the engine operation characteristic, and sampling an output from the pressure sensor at the peak crankshaft position.

27. The method according to claim 26, wherein determining a value of the engine operation characteristic comprises determining a position of a throttle valve which controls a flow of air through the induction system.

28. The method according to claim 27, wherein determining the peak crankshaft position comprises reading the peak crankshaft position from a map which includes data regarding a relationship between engine speed, throttle valve position, and peak crankshaft position.

29. A method for controlling the operation of the engine having an engine body, at least one combustion chamber defined in the body, a crankshaft journaled for rotation at least partially within the engine body, the method comprising determining a speed of rotation of the crankshaft, detecting a pressure in an induction system of the engine and generating an output signal indicative of the pressure detected, substantially maintaining a minimum value of the output signal, and sampling the minimum value maintained.

30. The method according to claim 29 additionally comprising resetting the maintained value.

31. The method according to claim 30, wherein resetting the maintained value is performed after sampling the minimum value maintained.

32. A engine comprising an engine body defining at least one combustion chamber therein, a crankshaft rotatably journaled at least partially within the engine body, an induction system configured to guide induction air into the combustion chamber, a pressure sensor configured to detect a pressure in the induction system and to output a signal indicative of the pressure detected, a charge former configured to supply a fuel charge to the combustion chamber, an engine speed sensor configured to detect rotation of the crankshaft, and a controller comprising means for sampling the output from the air pressure sensor at a timing based on a speed of rotation of the crankshaft and an engine operation characteristic other than engine speed.

33. The engine according to claim 32 additionally comprising means for maintaining a substantially minimum value of an output signal of the pressure sensor.

34. The engine according to claim 33 additionally comprising means for selectively resetting the maintained value.

35. The engine according to claim 32 additionally comprising a throttle valve controlling a flow of induction air through the induction system, wherein the engine operation characteristic is a position of the throttle valve.

36. A engine comprising an engine body defining at least one combustion chamber therein, a crankshaft rotatably journaled at least partially within the engine body, an induction system configured to guide induction air into the combustion chamber, a pressure sensor configured to detect a pressure in the induction system and to output a signal indicative of the pressure detected, a charge former configured to supply a fuel charge to the combustion chamber, an engine speed sensor configured to detect rotation of the crankshaft, and means for maintaining a substantially minimum value of an output signal of the pressure sensor.

37. The engine according to claim 36 additionally comprising means for selectively resetting the maintained value.

38. The engine according to claim 36 additionally comprising means for preventing the maintained signal from decaying.

* * * * *